United States Patent [19]

Nohara

[11] Patent Number: 4,717,146

[45] Date of Patent: Jan. 5, 1988

[54] ROTARY HEALTH PROMOTING EXERCISE APPARATUS

[75] Inventor: Hatsue Nohara, Gifu, Japan

[73] Assignee: G O Giken Co., Ltd., Gifu, Japan

[21] Appl. No.: 743,999

[22] PCT Filed: Sep. 26, 1984

[86] PCT No.: PCT/JP84/00459

§ 371 Date: May 21, 1985

§ 102(e) Date: May 21, 1985

[87] PCT Pub. No.: WO85/01447

PCT Pub. Date: Apr. 11, 1985

[51] Int. Cl.[4] ..... A63B 21/00; A61H 1/02

[52] U.S. Cl. ..... 272/73; 128/25 R

[58] Field of Search ..... 272/73, 144, 145, 93, 272/DIG. 6, 129, 69; 128/25 R, 25 B

[56] References Cited

U.S. PATENT DOCUMENTS

| | | | |
|---|---|---|---|
| 2,928,675 | 3/1960 | Nawara | 272/144 |
| 3,057,201 | 10/1962 | Jaeger | 272/93 |
| 3,212,776 | 10/1965 | Bassler | 128/25 R |
| 3,269,768 | 8/1966 | Kinney | 128/25 R |
| 3,451,674 | 6/1969 | Lundgren et al. | 272/73 |
| 3,602,502 | 8/1971 | Hampl | 272/DIG. 6 |
| 3,712,613 | 1/1973 | Feather et al. | 272/129 |
| 3,973,251 | 8/1976 | Stephas | 272/73 |
| 4,323,237 | 4/1982 | Jungerwirth | 272/DIG. 6 |
| 4,402,502 | 9/1983 | Peters | 128/25 R |
| 4,546,967 | 10/1985 | Kecala | 272/144 |

FOREIGN PATENT DOCUMENTS

| | | | |
|---|---|---|---|
| 1226506 | 2/1960 | France | 272/73 |
| 2076664 | 12/1981 | United Kingdom | 272/69 |

*Primary Examiner*—Richard J. Apley
*Assistant Examiner*—S. R. Crow
*Attorney, Agent, or Firm*—Stephen G. Rudisill

[57] ABSTRACT

The rotary health promoting exercise apparatus herein disclosed includes a base (1) in the form of a frame, a support housing (2) mounted thereon adjacent to one end thereof, a shaft (7) rotatably supported by the housing (2), pedal levers (8) attached to the shaft (7), an electric motor (11) for rotating the shaft (7), and a repose device (26) provided on the base (1) adjacent to the other end thereof for enabling the user (M) of the apparatus to stay in a posture of repose. The pedal levers (8) are rotated or reciprocally moved, while the user (M) stays in a posture of repose. The apparatus moves the arms or legs of the user and also allows him to move them himself, thereby enabling him to continue exercise without imposing any burden on his physical power. It also produces a massage effect which enables the user to recover from fatigue.

10 Claims, 26 Drawing Figures

ROTARY HEALTH PROMOTING EXERCISE APPARATUS

TECHNICAL FIELD

This invention relates to a rotary health promoting exercise apparatus which gives a rotary or reciprocal motion to legs or arms.

BACKGROUND ART

There is known a rotary health promoting exercise apparatus having pedals. Its user is, however, required to have a sufficient muscular power to turn the pedals himself. It is, therefore, unsuitable for a physically handicapped or aged person who does not intend to improve his muscular power, but merely wishes to use such an apparatus for the recovery or maintenance of the function of his joints or internal organs or the stimulation of his internal organs.

Even a healthy person finds it difficult to continue exercise every day at his own will if he is tired. The exercise even increases his fatigue. Therefore, it is not fully used. Moreover, the necessity of rotating the pedals makes it difficult to take exercise, while watching television or reading a book.

Massage, acupuncture and moxa cautery are all a method of stimulating or treating a body portion without relying on exercise.

Under these circumstances, it is a principal object of this invention to provide a rotary health promoting exercise apparatus which gives the legs or arms of its user a frequently repeated motion so that his power of locomotion may be fully and easily utilized while he remains in a posture of repose, i.e., sitting in a chair or on a floor or lying, and thereby enables the user to improve or restore his power of locomotion, recover from fatigue and maintain or recover good health and beauty.

It is another object of this invention to provide a rotary health promoting exercise apparatus which enables its user to move his body portions at his own will as he desires, while it moves them.

It is still another object of this invention to provide a rotary health promoting exercise apparatus in which the rotating speed of an electric motor for driving pedals can be so controlled as to prevent its failure.

It is a further object of this invention to provide a rotary health promoting exercise apparatus which is adjustable in shape in accordance with the height of its user.

It is a still further object of this invention to provide a rotary health promoting exercise apparatus which is foldable and convenient for storage or transportation.

It is a still further object of this invention to provide a rotary health promoting exercise apparatus which makes it possible to adjust the amount of exercise depending on the physical power of its user.

It is a still further object of this invention to provide a rotary health promoting exercise apparatus which enables its user to measure the amount of his exercise.

It is a still further object of this invention to provide a rotary health promoting exercise apparatus which gives its user both exercise and massage.

It is a still further object of this invention to provide a rotary health promoting exercise apparatus which enables its user to obtain easily a muscle stimulating action exerting a massage effect on the arches and calves of his feet when exercising his legs, or a stimulating action exerting a massage effect on the palms of his hands and the muscles of his front arms when exercising his arms.

DISCLOSURE OF THE INVENTION

A base 1 in the form of a frame has a body rest 26 on which the user M can stay in a posture of repose and a pair of pedal levers 8 connected to a shaft 7 are rotated or reciprocated by an electric motor 11 to move the arms or legs of the user M.

The user M can move his arms or legs at his own will if he stops the motor 11 and rotates a pair of pedals 9 himself.

The base 1 is provided with a plurality of positioning holes 24 along both edges close to one end thereof for mounting a stop member 25 so that its position may be changeable from one pair of holes 24 to another depending on the height of the user M.

A support housing 2 is foldable over the base 1 to facilitate the storage or transportation of the apparatus.

The apparatus provides the effects of both exercise and massage and enables the user to recover from fatigue, while taking exercise.

BRIEF DESCRIPTION OF THE DRAWINGS

FIG. 2 is a top plan view;

FIG. 3 is a fragmentary side elevational view showing an exercise mechanism and a mechanism for driving it;

FIG. 4 is a general cross sectional view of a torque limiter;

FIG. 5 is a fragmentary cross sectional view showing the connection of a shaft and a pedal lever;

FIGS. 6 to 9 are side elevational views showing other modes of use;

FIG. 10 is a side elevational view showing the tilting of a support housing;

FIG. 11 is a side elevational view showing the support housing in its folded position;

BEST MODE OF CARRYING OUT THE INVENTION

Figure 1:
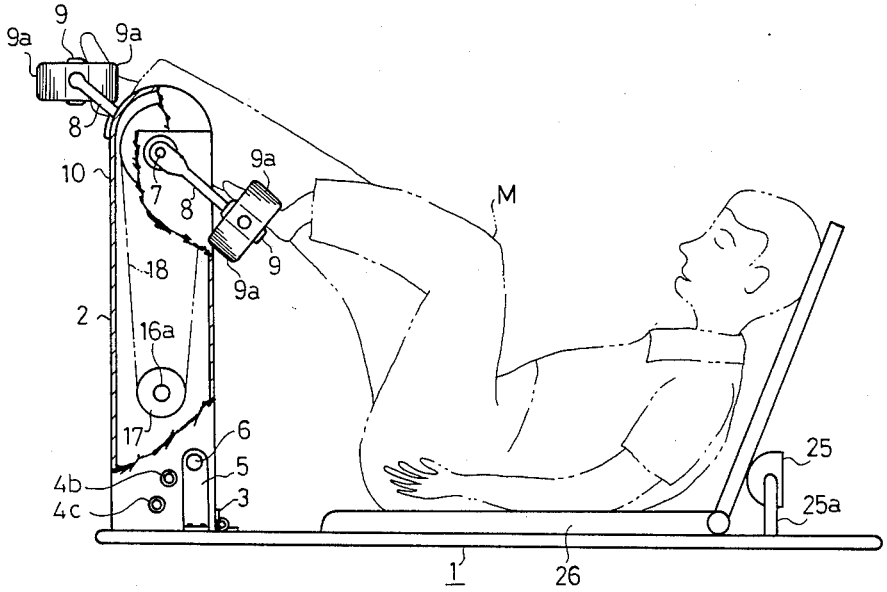
FIGS. 1 to 11 show a first embodiment of this invention and FIG. 1 is a side elevational view, partly in section, showing a mode of use by way of example.

A first embodiment of this invention is shown in FIGS. 1 to 15. A base 1 is provided with a base plate 1*a* at one end thereof as shown in FIG. 2 and a support housing 2 is supported on the base plate 1*a* by a hinge 3 tiltably as shown in FIG. 10. The housing 2 is provided on one side thereof with a plurality of stop holes 4*a* to 4*c* located in a circle having its center on the hinge 3. A bracket 6 is upstanding from the base plate 1*a* and a stop pin 6 which is threadedly connected to the bracket 5 is receivable in any of the stop holes 4*a* to 4*c* for holding the housing 2 in an upright or tilted position.

Figure 5:
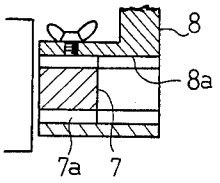

A shaft 7 is carried by the housing 2 adjacent to its upper end and has a pair of outwardly projecting ends. A pedal lever 8 is threadedly secured to each end of the shaft 7. The shaft 7 has an external thread 7*a* engaged with the internal thread 8*a* of the pedal lever 8 as shown in FIG. 5. A pedal 9 is rotatably supported on the opposite end of each pedal lever 8. A foot holding cover 9*a* surrounds each pedal 9. A driven sprocket 10 is secured to the shaft 7.

Figure 3:
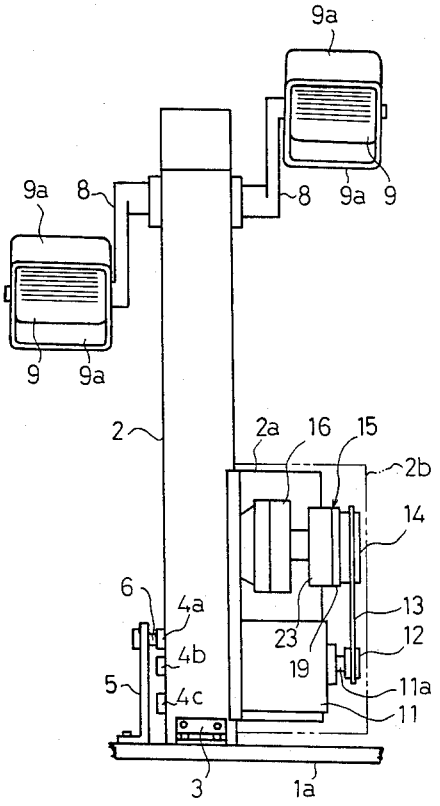

An electric motor 11 and a speed reducer 16 are mounted on a mounting plate 2*a* secured to the housing 2 adjacent to its lower end as shown in FIG. 3. The motor 11 has an output shaft 11*a* to which a pulley 12 is secured. A driven pulley 14 is connected to the speed reducer 16 by a torque limiter 15 and to the pulley 12 by a V belt 13. The motor 11, torque limiter 15, speed reducer 16, etc. are enclosed in a cover 2*b* attached to the housing 2. The speed reducer 16 has an output shaft 16*a* located in the housing 2 and a sprocket 17 is secured to the output shaft 16*a* and connected to the driven sprocket 10 on the shaft 7 by a chain 18, as shown in FIG. 1.

Figure 4:
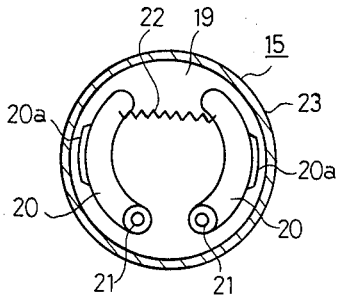

The torque limiter 15 is of the known construction and comprises a disk 19, a pair of arms 20 rotatably supported by pins 21 on the disk 19 and a spring 22 extending between the free ends of the arms 20 and urging them to approach each other, as shown in FIG. 4. The disk 19 is secured to the driven pulley 14 shown in FIGS. 2 and 3. The rotation of the driven pulley 14 causes the disk 19 to rotate and the arms 20 are centrifugally moved away from each other against the force of the spring 22. Each arm 20 has a contact member 20*a* which is brought into contact with the inner surface of a driven cylinder 23. The rotation of the disk 19 is, therefore, transmitted to the speed reducer 16 through the driven cylinder 23. The pulley 12, V belt 13, driven pulley 14, torque limiter 15, speed reducer 16, sprocket 17, chain 18 and driven sprocket 10 constitute a rotation transmission mechanism.

The base 1 is provided with a plurality of positioning holes 24 along both edges adjacent to the opposite end thereof as shown in FIG. 2. A stop tie 25 has at each end a supporting rod 25*a* which is engageable in one of the holes 24 at one edge of the base 1 so that the position of the stop tie 25 may be changeable from one pair of holes 24 to another in accordance with the height of the user M.

Figure 2:
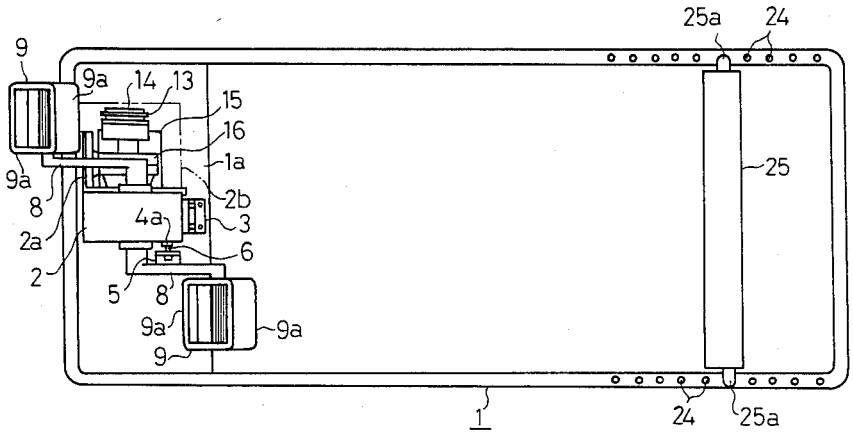
Figure 6:
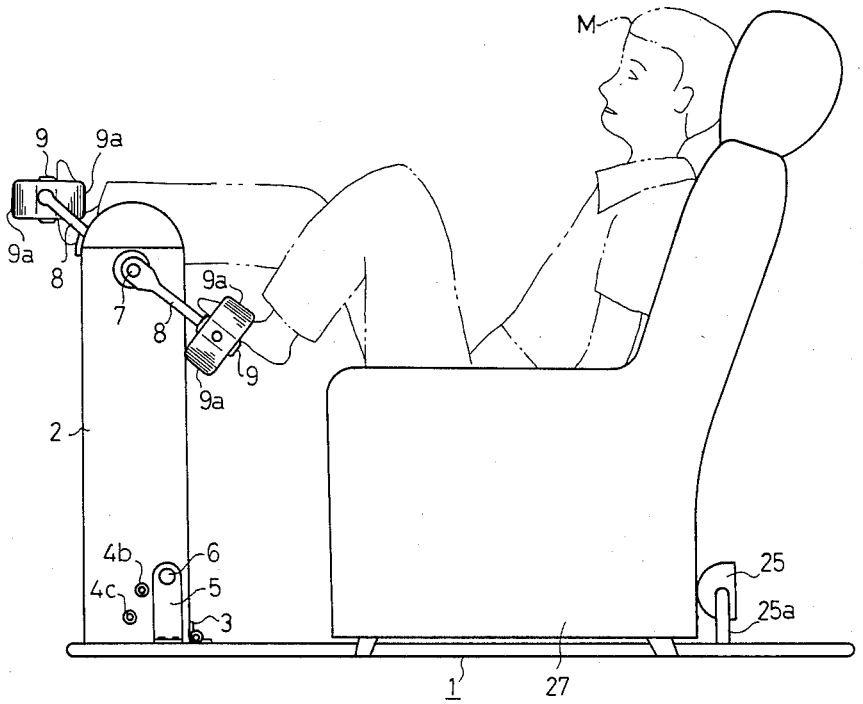

The user M who is going to use the apparatus as above described selects the position of the stop tie 25 in accordance with his height and places a legless chair 26 between the support housing 2 and the stop tie 25 as shown in FIG. 1. The chair 26 is supported by the stop tie 25. He sits down on the chair 26 and puts his feet in the foot holding covers 9*a* of the pedals 9, respectively. If he places the motor 11 in operation, its rotation is transmitted to the driven sprocket 10 through the torque limiter 15, speed reducer 16 and chain 18 to rotate the pedal levers 8, whereby his legs are rotated. The legless chair 26 can be replaced by an armchair 27 as shown in FIG. 6. This mode of use is convenient for the exercise of the arms as shown in FIGS. 7 and 8.

Although the position of the legless chair 26 or the armchair 27 must be changed to suit the height of the user M or other factors, the stop tie 25 is variable in position to support the back of the legless chair 26 or the armchair 27 and prevent any displacement thereof to ensure the safety of the user while he is taking exercise.

Figure 7:
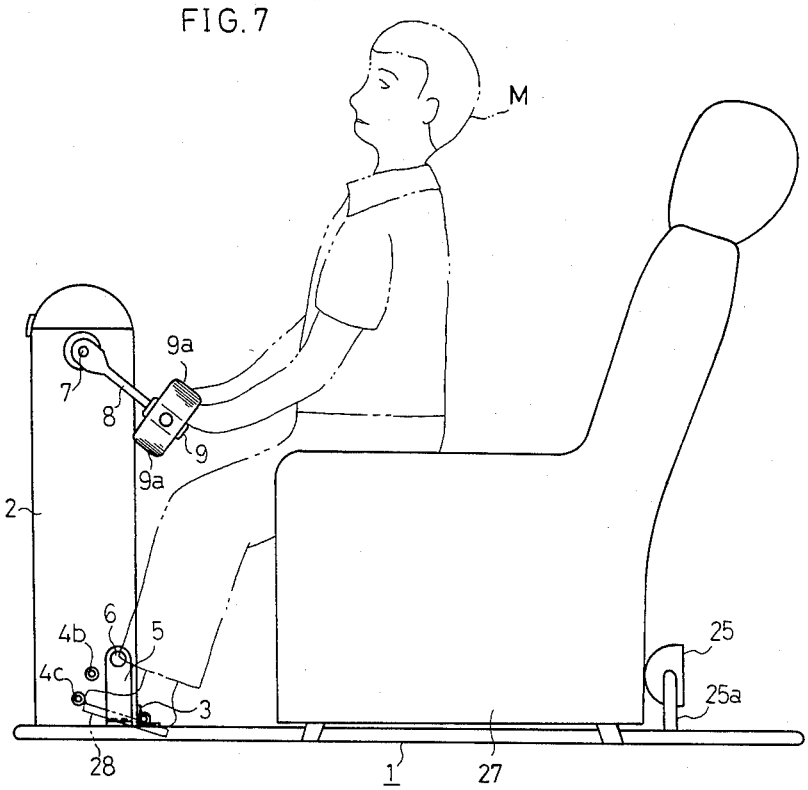
Figure 8:
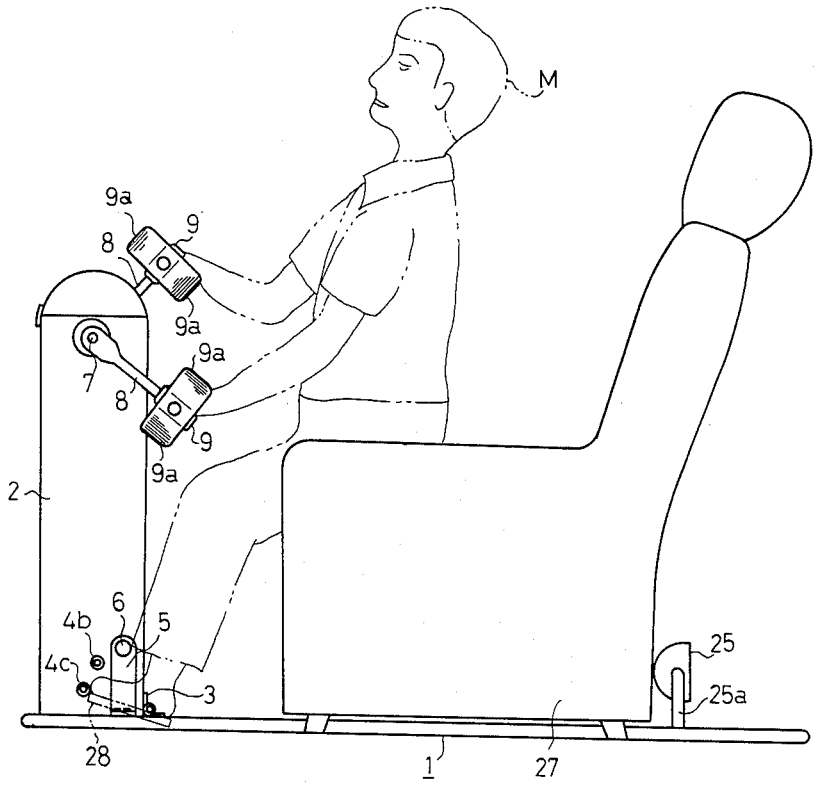

Although FIG. 1 shows the pedal levers 8 mounted with an angle of 180° therebetween, it is possible to detach them from the shaft 7 and replace them in parallel to each other as shown in FIG. 7, or with an angle of about 90° therebetween as shown in FIG. 8. If the user M puts his hands in the covers 9*a* and starts the motor 11, the pedal levers 8 are rotated to rotate his arms. The angle between the pedal levers 8 is variable in 18 ways.

Figure 9:
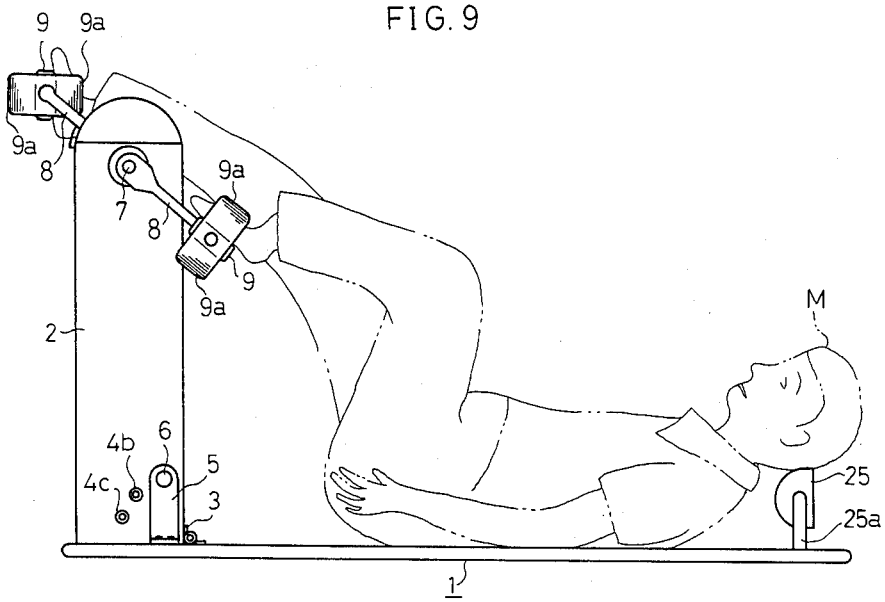
Figure 10:
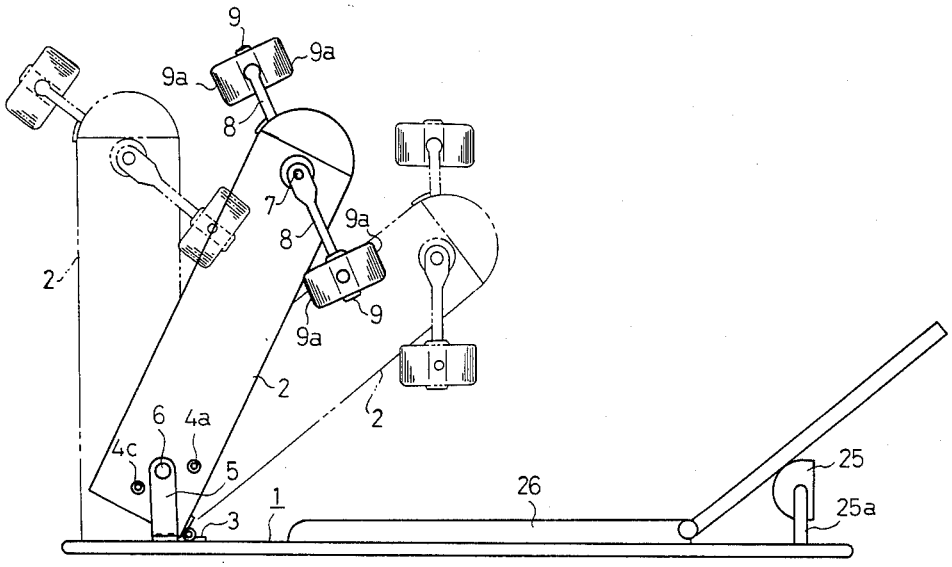

It is also possible for the user M to have his head supported directly on the stop tie 25 and lie on the base 1 as shown in FIG. 9.

The user can cause the pedal levers 8 to rotate at a speed higher or lower than the predetermined rotating speed of the shaft 7 in accordance with his physical power, as the slippage in the torque limiter 15 creates a rotational resistance defined by the rated torque of the motor 11 and the acceleration resistance of the speed reducer 16. It is also possible for the user M to stop the motor 11 and rotate the pedal levers 8 himself so that he can move his arms or legs at his own will. In this case, the speed reducer 16 functions as a speed increaser and imparts a rotational resistance to the user M so that he can use the apparatus for taking exercise in a conventional way.

The torque limiter 15 protects the motor 11 against burning or any other accident due to a load exceeding the rated load when so force resisting the rotation of the pedals 9 has been applied or when an attempt has been made to rotate it faster than at a predetermined rotating speed. In the event any excessive force has acted on the pedals 9, it discontinues the rotation of the pedals 9 to ensure the safety of the user M.

Figure 11:
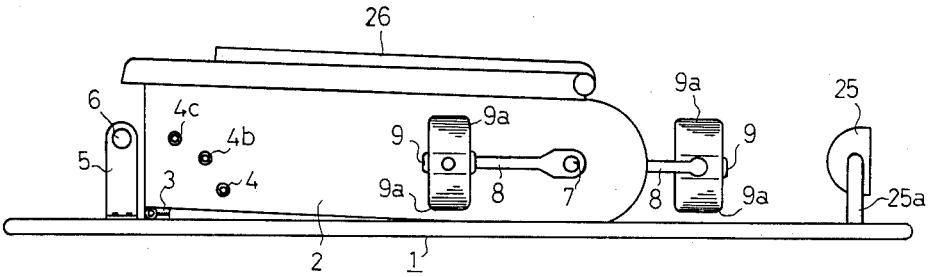

The housing 2 is tiltable about the hinge 3 in a number of different ways to enable the user M to use the apparatus in an optimum position which suits his height or his posture, such as sitting on a legless chair or armchair or lying, as shown in FIG. 10. When the apparatus is not in use, the housing 2 can be folded to lie on the base 1, as shown in FIG. 11, if the stop pin 6 on the bracket 5 is removed from the stop hole 4*a*, 4*b* or 4*c* of the housing 2. The tiltable and foldable housing facilitates the storage or transportation of the apparatus.

It is possible to modify the first embodiment as will hereinafter be set forth:

(A) It is possible to provide a pair of stationary footrests 28 on both sides of the housing 2 as shown in FIGS. 7 and 8.

(B) It is possible to replace the torque limiter 15 by one of other construction or a similarly working centrifugal clutch.

Figure 12:
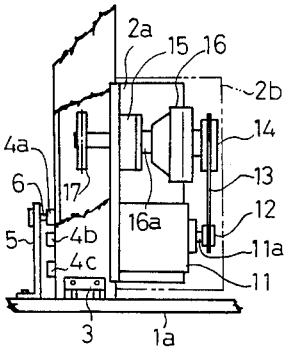
FIGS. 12 and 13 are fragmentary side elevational views showing modifications to the first embodiment which are each characterized by a differently positioned torque limiter.
Figure 13:
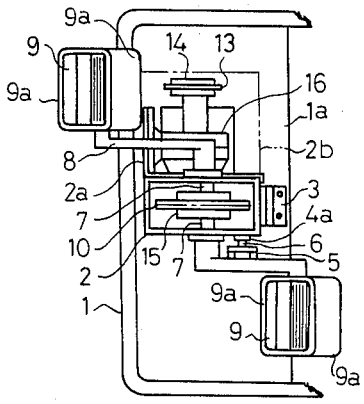

(C) It is possible to dispose the torque limiter 15 between the output shaft 16*a* of the speed reducer 16 and the sprocket 17 as shown in FIG. 12 or between the driven sprocket 10 and the shaft 7 as shown in FIG. 13. In any such case, a friction clutch is used for the torque limiter 15.

(D) The motor 11 may be of the type which is rotatable in both directions.

Figure 14:
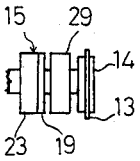
FIG. 14 is a fragmentary side elevational view showing a modification to the first embodiment which includes a centrifugal brake.
Figure 15:
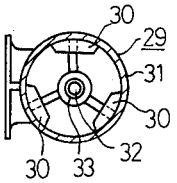
FIG. 15 is a general cross sectional view of the centrifugal brake.

(E) It is possible to provide a known centrifugal brake 29 between the driven pulley 14 and the torque limiter 15 as shown in FIG. 14. The brake 29 has a plurality of weights 30 urged radially inwardly by springs, and when they are rotated, a centrifugal force urges them radially outwardly against the force of the springs and brings them into contact with an outer ring 31 to produce a braking action. The brake 29 has a central rotary shaft 32 to which the rotation of the motor 11 is transmitted, and on which a one-way clutch 33 is provided. The clutch 33 prevents the rotation of the motor 11, which is rotatable only in one direction, from being transmitted to the weights 30. Therefore, if the user M stops the motor 11 and rotates the pedal levers 8 at a certain speed himself in order to use the apparatus for taking exercise at his own will, the rotation thereof is transmitted to the weights 30 through the one-way clutch 33. The centrifugal brake 29, therefore, produces a braking action which exerts a rotational resistance on the user M. This resistance and the rotational resistance created by the torque limiter 15 enable the user to take an optimum amount of exercise which suits his physical power.

(F) The motor 11 and the speed reducer 16 may be of the variable speed type so that the rotating speed of the pedal levers 8 may be adjustable.

(G) It is possible to provide a timer or a rotation meter in a motor circuit so that a buzzer may sound, or the pedal levers 8 may automatically stop rotating when they have finished rotating for a predetermined period of time or a predetermined number of revolutions.

Figure 16:
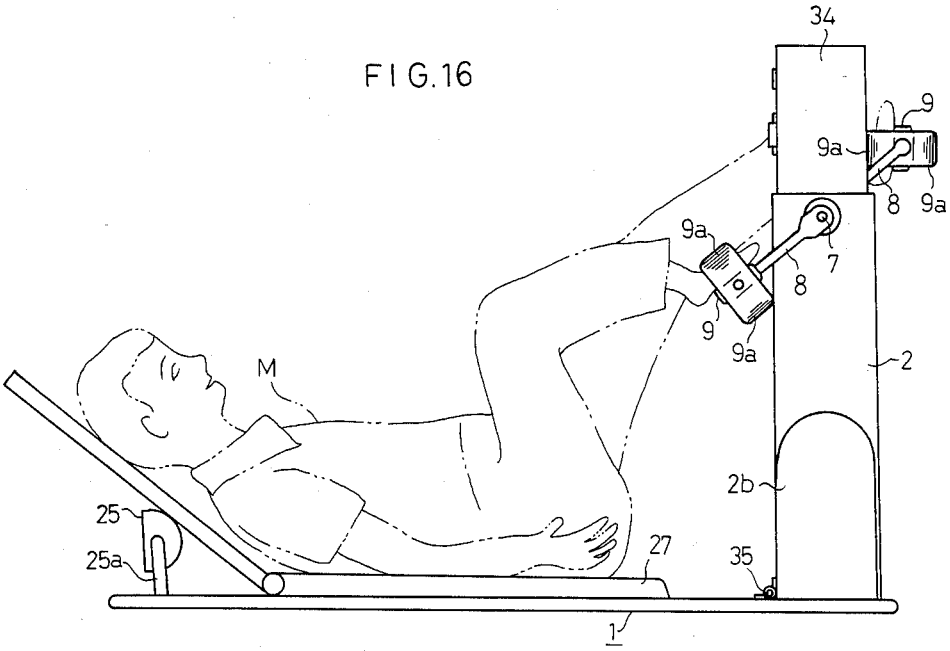
FIG. 16 is a side elevational view showing a second embodiment of this invention.
Figure 20:
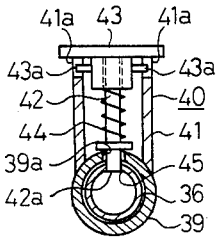
FIG. 20 is a fragmentary cross sectional view showing a stop member in the apparatus of FIG. 18.
Figure 17:
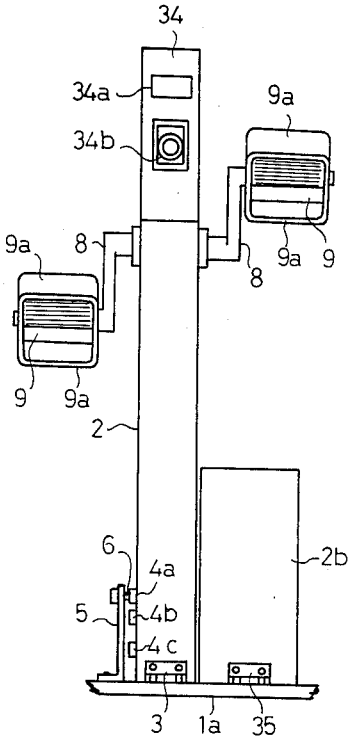
FIG. 17 is a fragmentary side elevational view thereof.
Figure 19:
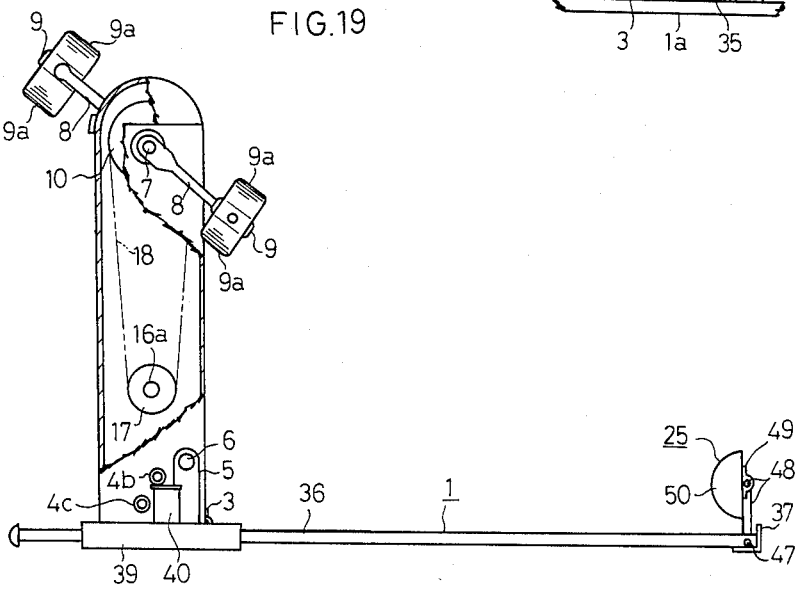
FIG. 19 is a side elevational view, partly in section, thereof.
Figure 18:
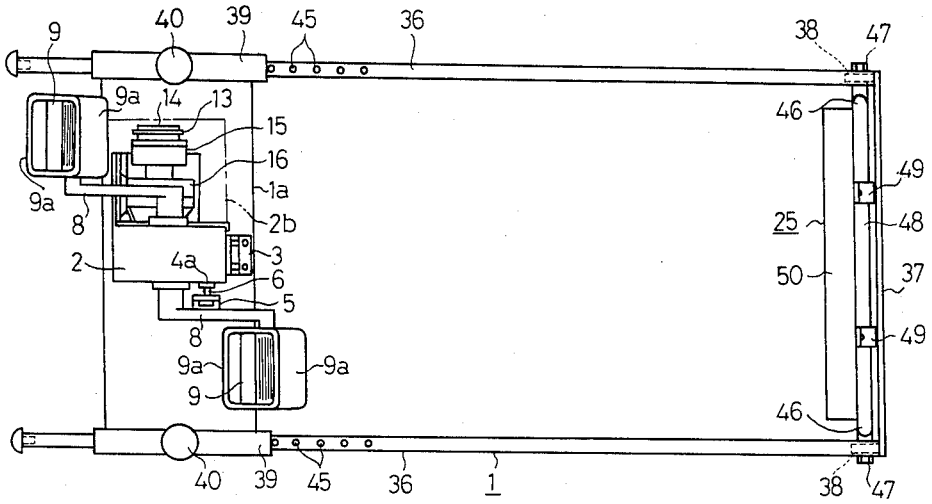
FIG. 18 is a top plan view showing a third embodiment of this invention.
Figure 22:
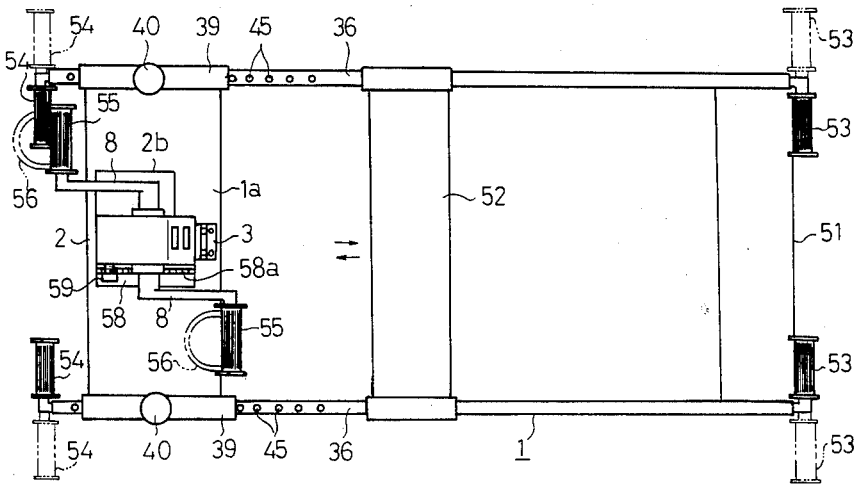
FIG. 22 is a top plan view showing a fourth embodiment of this invention.

A second embodiment of this invention is shown in FIGS. 16 and 17. A revolution counter 34 is secured to the upper end of a support housing 2 for counting the number of revolutions of a shaft 7 for pedal levers 8. The counter 34 includes a counter unit 34*a* and a timer 34*b* which indicates the period of time for which the pedal levers 8 have been rotated. The housing 2 is tiltable and a cover 2*b* enclosing an electric motor 11 and a speed reducer 16 is also tiltable about a hinge 35. When the housing 2 is tilted in a number of ways as shown in FIG. 10, the cover 2*b* is also tilted in a similar way.

The number of revolutions of the pedal levers 8 is indicated on the counter 34*a* enables the user M to know the amount of exercise which he has taken and adjust it in accordance with his physical power, while watching the counter 34*a*.

Reference is now made to FIGS. 18 to 21 showing a third embodiment of this invention. A frame is formed by a pair of pipes 36 and a connecting plate 37 extending between the ends of the pipes 36. A tapered pin 38 projects from each end of the connecting plate 37 into the corresponding pipe 36.

A sliding cylinder 39 is secured to each side edge of the base plate 1*a* on which a support housing 2 is mounted. Each pipe 36 extends through one of the sliding cylinders 39. Each sliding cylinder 39 is provided with a stop member 40.

Referring to each stop member 40 in detail, it comprises a cylindrical body 41 secured to the outer surface of the sliding cylinder 39, a stop rod 42 in the cylindrical body 41, a control knob 43 fitted about the upper end of the stop rod 42 and a spring 44 urging the knob 43 downwardly. The pipe 36 has a plurality of positioning holes 45 and the stop rod 42 has a lower stop end 42*a* which is engageable in any of the positioning holes 45. The knob 43 has a pair of diametrically opposite projections 43*a* and the cylindrical body 41 is provided at its upper end with a pair of diametrically opposite recesses 41*a* in which the projections 43*a* are engageable. If the knob 43 is raised against the force of the spring 44 and turned by 90° to have its projections 43*a* rest on the upper end of the cylindrical body 41, the lower end 42*a* of the stop rod 42 is removed from the positioning hole 45 and the sliding cylinder 39 is slidable along the pipe 36. The base plate 1*a* and the housing 2 mounted thereon are, therefore, movable to an appropriate position. If each knob 43 is, then, brought back to its position shown in FIG. 20, the lower end 42*a* of the stop rod 42 is inserted in the corresponding positioning hole 45 of the pipe 36 to disable the movement of the sliding cylinder 39 along the pipe 36 so that the base plate 1*a* and the housing 2 may be fixed in position.

Figure 21:
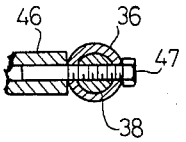
FIG. 21 is a fragmentary cross sectional view showing a stop tie in the apparatus of FIG. 18.

A stop tie 25 includes a transverse rod 46 extending between the pipes 36 adjacent to the connecting plate 37. A pair of holding bolts 47 threadedly extend diametrically through the pipes 36 and the tapered pins 38 of the connecting plate 37 into the opposite ends of the transverse rod 46, as shown in FIG. 21, so that the rod 46 may be rotatable about the inner ends of the bolts 47. A supporting rod 48 which is substantially semicircular in side elevation is secured to the transverse rod 46. The stop tie 25 has a pillow portion 50 supported rotatably on the supporting rod 48 by a pair of fixtures 49.

A fourth embodiment of this invention is shown in FIGS. 22 to 25. It is a partial modification to the third embodiment and differs therefrom as will hereinafter be described. A stationary leg support 51 is secured between the ends of the pipes 36 remote from the ends between which the base plate 1*a* is provided. A movable leg support 52 is provided between the base plate 1*a* and the stationary leg support 51 movably along the pipes 36. A stop rod 53 is engaged with the end of each pipe 36 adjacent to the stationary leg support 51 rotatably between its inner position shown by solid lines in FIG. 22 and its outer position shown by phantom lines. An armchair as shown at 27 in FIG. 6 can be placed on the leg supports 51 and 52 if the movable leg support 52 is moved appropriately. The stop rods 53 in their inner positions are held against the back of the armchair 27 and prevent any displacement of the armchair 27 when the user is taking exercise. If the armchair 27 has a leg distance which is larger than the distance between the pipes 36 and its legs are located outside the pipes 36, the stop rods 53 are rotated to their outer positions to prevent any displacement of the armchair 27. A foot supporting rod 54 is likewise fitted on the other end of each pipe 36 adjacent to the base plate 1*a*.

Figure 24:
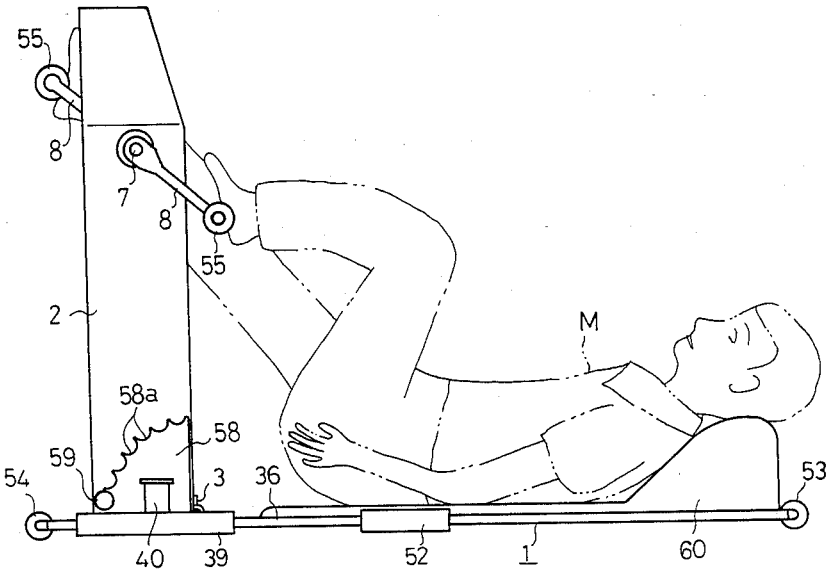
FIGS. 24 to 26 are side elevational views showing by way of example modes in which the apparatus according to the fourth embodiment is used.
Figure 25:
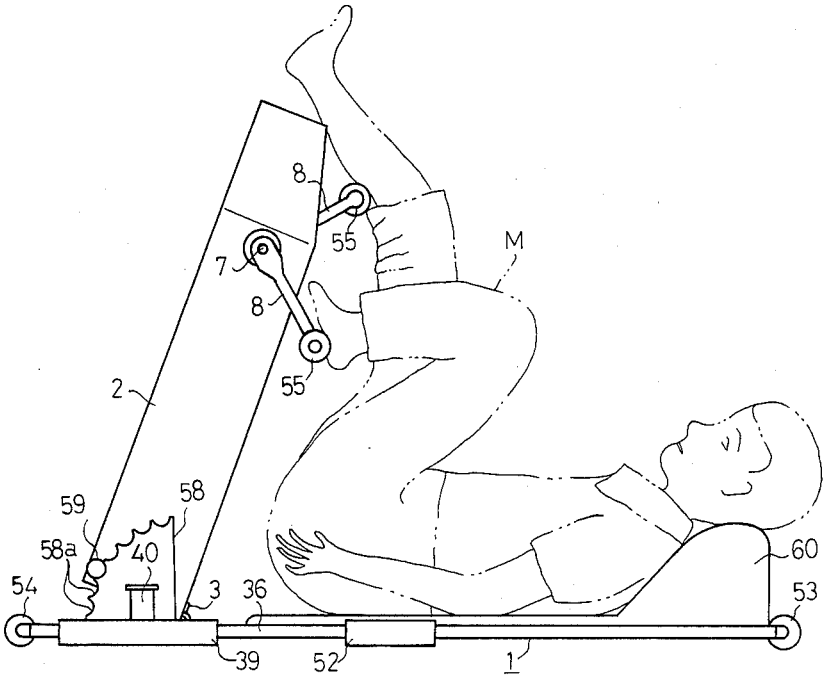
Figure 26:
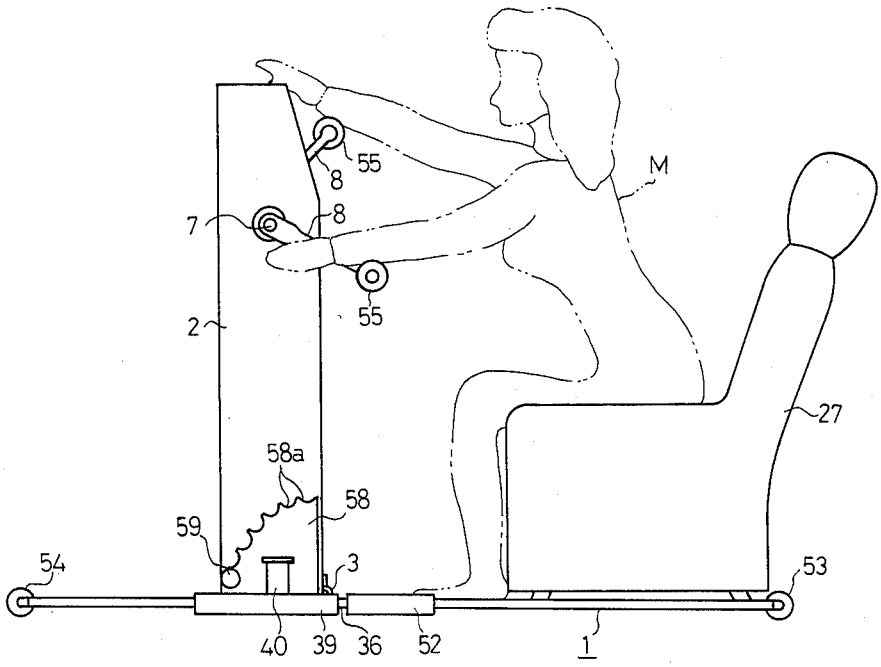

A rubber tube 55 is fitted about the free end of each pedal lever 8 instead of the pedal 9 in the third embodiment. Each rubber tube 55 has a corrugated outer peripheral surface. If the pedal levers 8 are rotated with the soles or calves resting on the rubber tubes 55 as shown in FIGS. 24 and 25, the rubber tubes 55 press the soles or calves while rotating reciprocally and thereby stimulate the muscles in the plantar arches or calves. They are also useful for stimulating the muscles in the palms or the front arms. A removable foot holding cover 56 formed from rubber may be attached to each rubber tube 55 as shown by phantom lines in FIG. 22. A tube of, for example, a synthetic resin or wood may be employed instead of each rubber tube 55.

Figure 23:
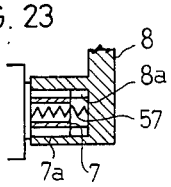
FIG. 23 is a fragmentary cross sectional view showing the connection of a shaft and a pedal lever.

A spring 57 is disposed between the shaft 7 and each pedal lever 8 to hold the pedal lever against detachment from the shaft 7, as shown in FIG. 23. If it is desirable to change the angle between the pedal levers 8, they can be detached from the shaft 7 against the force of the springs 57 and if they are connected in a different position relative to the shaft 7, the springs 57 hold them against detachment from the shaft 7 again.

A bracket 58 having a shape which is equal to a quarter of a circle is secured to the base plate 1*a* adjacent to the housing 2. It has a plurality of concavities 58*a* on its arcuate edge. When the housing 2 is in its upright position, a stop screw 59 is engaged in the lowermost concavity 58*a* as shown in FIG. 24 and in a female screw thread formed on the housing 2, though not shown. The housing 2 is tiltable as shown in FIG. 10 if the screw 59 is removed from the female screw thread of the housing 2 and if the female screw thread is aligned with another concavity 58*a* and the screw 59 is replaced. The housing 2 can be fixed in a new position as shown by way of example in FIG. 25. The bracket 58, concavities 58*a* and screw 59 constitute a means for tilting the support housing.

It is possible to use a bed 60 instead of a legless chair 26 or an armchair 27, as shown in FIG. 24.

I claim:

1. A rotary health promoting exercise apparatus comprising a base (1), a support housing (2) thereon, a shaft supported rotatably on said housing, a pair of pedal levers (8) attached to said shaft, an electric motor (11) operationally connected to said shaft by a rotation transmitting means for driving said shaft at a predetermined rotating speed, and a repose means (26, 27 and 60) provided on said base (1) to enable the user (M) of the apparatus to stay in posture of repose when exercising by rotating of said pedal levers (8), said rotation transmitting means including a torque limiter (15) which is slippable when said pedal levers are rotated at a speed higher or lower than said predetermined rotating speed controlled by said motor.

2. An apparatus as set forth in claim 1, wherein said motor (11) has a circuit provided with a timer which counts the rotating time of said pedal levers (8) and the number of their revolutions and causes a buzzer to sound or the motor (11) to stop automatically when said time and said number have exceeded predetermined values.

3. An apparatus as set forth in claim 1, wherein said housing (2) has a plurality of stop holes (4*a* to 4*c*) on one side thereof, and an upstanding bracket (5) faces said housing (2) and has threaded stop pin (6) which is removably fitted in one of said holes (4*a* to 4*c*), said housing (2) being foldable on said base (1) upon removal of said pin (6) from said holes (4 *a* to 4 *c*).

4. An apparatus as set forth in claim 1, wherein said housing (2) is provided with a revolution counter (34) for counting the number of revolutions, of said shaft (7) and a count indicator (34*a*) which indicates the number counted by said counter (34).

5. An apparatus as set forth in claim 1, further including a pedal (9) rotatably attached to the free end of each of said pedal levers (8).

6. An apparatus as set forth in claim 1, further including a tube (55) provided on the free end of each of said pedal levers (8) for stimulating the planter arch or calf of the user when he exercises his legs, and the muscles in the palm or front arm when he exercises his arms.

7. An apparatus as set forth in claim 1, wherein said motor (11) is rotatable in both directions.

8. An apparatus as set forth in claim 1, wherein said base (1) includes a base plate (1*a*) extending transversely between a pair of edges adjacent to one end thereof, said housing (2) being supported on said base plate (1*a*), wherein said base plate (1*a*) includes a sliding cylinder (39) secured to each edge thereof, and wherein said base (1) further includes a pair of pipes (36) each extending through one of said sliding cylinders (39) and provided with a control knob (43) which enables the sliding movement of each sliding cylinder to alter the position of said housing (2) relative to said base (1).

9. An apparatus as set forth in claim 1, further including a means for tilting and folding said housing (2) relative to said base (1).

10. An apparatus as set forth in claim 9, wherein said tilting means comprises a bracket (58) secured to said base plate (1*a*) adjacent to said housing (2) and having a shape which is equal to a quarter of a circle and thereby defines an arcuate edge formed with a plurality of concavities (58*a*), and a screw (59) removably engaged in one of said concavities and a female screw thread formed on said housing (2).

* * * * *